US005370570A

United States Patent [19]

Harris

[11] Patent Number: 5,370,570

[45] Date of Patent: Dec. 6, 1994

[54] PORTABLE MOBILE

[76] Inventor: Steven O. Harris, HHC, 1-15 IN, CMR 464, Box 1575, APO AE, U.S., 09226

[21] Appl. No.: 53,885

[22] Filed: Apr. 27, 1993

[51] Int. Cl.[5] ..... A63H 33/00; A47D 15/00; E04G 3/00; A41F 1/00

[52] U.S. Cl. ..... 446/227; 24/486; 248/104; 248/231.7; 248/279

[58] Field of Search ..... 446/175, 227, 228, 229, 446/268; 24/486, 527; 248/104, 231.4, 231.7, 278, 279, 287, 316.4; 269/82, 97, 98, 249

[56] References Cited

U.S. PATENT DOCUMENTS

| | | | |
|---|---|---|---|
| 1,854,302 | 4/1932 | Hansen | 248/279 |
| 1,900,691 | 3/1933 | Carlson | 248/287 |
| 2,443,242 | 6/1948 | Hansen et al. | 248/279 |
| 2,680,588 | 6/1954 | Wright | 248/231.4 |
| 3,358,957 | 12/1967 | Lindenmuth | 248/279 |
| 3,977,645 | 8/1976 | Deely | 248/278 X |
| 4,147,344 | 4/1979 | Lee | 446/227 X |
| 4,458,870 | 7/1984 | Duncan et al. | 248/279 |
| 4,735,388 | 4/1988 | Marks | 248/287 X |
| 4,858,990 | 8/1989 | Combs-Rose et al. | 248/279 X |
| 4,892,283 | 1/1990 | Cutburth | 248/287 X |

OTHER PUBLICATIONS 4904 220 Feb. 1990 Williams et al. 446-227.

*Primary Examiner*—Robert A. Hafer
*Assistant Examiner*—D. Neal Muir
*Attorney, Agent, or Firm*—George W. Dishong

[57] ABSTRACT

An improved portable mobile toy having at least one element attached to and suspended from an umbrella structure with an improved support system to which the umbrella structure is rotatably attached. The improvement comprises a clamping assembly which is adaptable and adjustable for attaching to a variety of fixtures such as chairs, tables, car windows, as well as to cribs and playpens. The support system includes a pair of beams which are connected to the clamping assembly. The beams are so connected to permit rotation and pivoting about the clamping assembly. The two beams are rotatable relative to each other and when in the selected relative position they are clamped so that they do not then move relative to each other. One of the pair of beams may be lengthwise adjustable and may be used by itself; that is, one end attaches to the umbrella portion and the other end to the clamping assembly. The improved portable mobile may be easily disassembled, packaged for easy transport and reassembled for use in a different environment.

6 Claims, 6 Drawing Sheets

PORTABLE MOBILE

BACKGROUND OF THE INVENTION

1. Field of the Invention

This invention most generally relates to a device which is used for the entertainment of infants while in a playpen, car seat, high chair etc., frequently referred to as a "MOBILE". More particularly it relates to an improved portable mobile toy having at least one element attached to and suspended from an umbrella structure with an improved support system to which the umbrella structure is rotatably attached. The improvement support system has a clamping assembly which is adaptable and adjustable for attaching to a variety of fixtures such as chairs, tables, car windows, as well as to cribs and playpens. The support system also includes in the preferred embodiment, a pair of beams which are connected to the clamping assembly. The improved mobile has adjustments which permit the easy disassembly of the mobile and also permit the selective positioning of the umbrella structure and the toys suspended therefrom over or otherwise proximate the infant or child who is playing with and/or simply viewing the mobile.

2. Description of the Prior Art

Infant mobiles currently offered on the market today are frequently limited to use over a baby's crib. Once mounted to the crib rail or to the wall next to the infants bed, these mobiles have reached their full potential in offering visual enjoyment to the infant. Babies are also limited to the amount of enjoyment they can get from these types of mobiles, as they only view them just prior to going to sleep or immediately upon awakening. The overall infant mobile concept is far too good a concept to be so very limited in its use.

Most of the mobiles presently used do not provide for use other than with a crib or playpen primarily because they do not provide any versatility with regard to the attachment to fixtures other than cribs and playpens. Because of such limited use the toys generally suspended from a so-called umbrella portion are at a fixed or determined distance from the infant. This distance should be adjustable or variable because as the infant matures eyesight improves and the view of the toys of the mobile becomes more acute. Clearly, mobiles would find longer and more frequent use by infants and children if the umbrella was moveable to being more closely positioned to the infant.

The angle or the attitude of the present and typical mobile based upon the structure of the presently known mobiles, does not allow the use of the mobile in a manner which differs substantially from that noted above, i.e., use with a crib or playpen. It is clear that if a mobile was available which had features allowing the use of the mobile in situations other than attached to a crib, such an improved mobile would satisfy a real need for providing infants with entertainment in an environment other than in a crib or playpen. This improved mobile may also provide entertainment beyond the infant stage since the mobile is more versatile.

As indicated above, presently there is nothing available that provides for the adaptability of a mobile toy so that it may be and can be used in circumstances additional to use by an infant while in a crib or playpen. It would be advantageous to have a mobile toy which would, without a large expense, be versatile in that the toys suspended from the umbrella could be adjustably positioned at a preferential position relative to the infant. It would also be advantageous to have a mobile which is not only improved from the viewpoint of being able to adjust the position of the toys relative to the infant or child enjoying the mobile toy, but also having features which provide for the portability of the mobile and the use of the mobile in environments in which present mobiles are not used, and conveniently cannot be used, including their use in automobiles.

The following patents relate to the technology of the present invention but none of them meets the objects of the mobile defined and described herein in a manner like that of the instant invention. Neither are any of them as effective and as efficient as the instant improved mobile.

| U.S. Pat. Nos. | Inventor | Issue Date |
|---|---|---|
| 4,984,380 | Anderson | 01/15/91 |
| 4,904,220 | Williams et al | 02/27/90 |
| 4,702,719 | Lapid | 10/27/87 |
| 4,619,626 | Tarulli | 10/28/86 |
| 4,147,344 | Lee | 04/03/79 |
| 3,593,952 | Smith | 07/20/71 |
| 3,374,347 | Hirose | 03/19/65 |
| 3,290,817 | Kravath | 12/13/66 |
| 2,994,156 | Steiner et al | 08/01/61 |
| 2,434,986 | Bremer | 01/27/48 |

Essentially all of the patents are of special interest in that they all are directed to mobile toys, exercise devices, amusement devices, special crib mobile that is body activated, puppet mobile all of which are supported or suspended for play access by the infant. Additionally there are patents which disclose ways of providing adjustable support systems as applied not only to toy mobiles but also to lamps and therapeutic devices.

It is important to first note that Lee and Anderson are very specially designed mobiles which are relatively complex and which have such special features as exercise and the activation of the mobile when there is motion by the infant. Lee does not represent or teach an invention which is any way similar in structure and purpose as the present invention. Anderson discloses an articulating arm with a "hook" end to support the mobile.

The Kravath mobile toy is particularly directed to providing a simulated bird. Means is taught for attaching to the rail of a playpen or crib. See element numbered 3 in FIG. 1 of Kravath.

The Williams et al puppet mobile is a mobile which may be attached to the side of a crib, night stand, bedside table or shelf. Williams et al also discloses support paddles for holding hand puppets and which paddles are movable between an upright and an inclined position and a music producing systems based upon a windup apparatus. Williams et al teaches adjustable support arms and extension arms.

Lapid is very particularly directed to a device for suspending infant toys such as mobiles. The element 50 of FIG. 3 is a bar which is foldable for easy transport and storage.

The patents to Smith, Hirose and more particularly to Bremer relate to means or method for providing adjustability to devices such as lamps. Bremer teaches articulating arms with adjustable joints having knobs (51 of FIG. 3) to hold the arms in position when tightened down.

Clearly the instant invention provides many advantages over the prior art inventions noted above. Again it is noted that none of the prior art meets the objects of the improved portable mobile as defined and described herein and accomplishes such objects in a manner like that of the instant invention. None of them are as effective and as efficient in the universality of the use as the instant mobile. None of the prior art known to the inventor hereof satisfies the need for a mobile toy which has use beyond the crib and playpen and which is adapted to permit the adjustment of the positioning of the toys relative to the infant. No one has considered the advantages of providing a mobile in which the beam structure, that is the structure between the means for attaching the mobile to a fixture (crib, bed, playpen, stroller, counter top, automobile window and the like), permits the orientation of the toys suspended from the umbrella to be adjustably positioned relative to the infant who is enjoying the mobile toy.

The invention disclosed herein is an improved, portable, foldable and consequently more useful mobile.

SUMMARY OF THE INVENTION

The present invention in it's most simple form or embodiment is directed to an improved portable mobile toy having at least one element attached to and suspended from an umbrella structure with an improved support system to which the umbrella structure is rotatably attached. The improved support system has a clamping assembly which is adaptable and adjustable for attaching to a variety of fixtures such as chairs, tables, car windows, as well as to cribs and playpens. Also included is preferably a pair of beams which are connected to the clamping assembly. The beams are so connected to permit rotation and pivoting about the clamping assembly. The two beams are rotatable relative to each other and when in the selected relative position they are clamped so that they do not then move relative to each other. One of the pair of beams may be lengthwise adjustable and may be used by itself; that is, one end attaches to the umbrella portion and the other end to the clamping assembly. The improved portable mobile may be easily disassembled, packaged for easy transport and reassembled for use in a different environment.

An object of the invention is to provide an improved portable mobile toy having; at least one element attachable and suspendable from an umbrella structure, and an improved support system to which the umbrella structure is rotatably attachable. The improvement comprises: means for removably attaching the support system to a fixture such as a crib, playpen, chair, table, the window glass of an automobile door etc.—a clamping assembly. This clamping assembly is configured to be adjustable for attaching to varying fixture geometries. There is also provided a means for rotatably, pivotaly and removably connecting the beam suspension portion of the support system to the clamping assembly. The beam suspension portion comprises; a first beam having one end adapted to cooperate with said means for rotatably, pivotaly and removably connecting to the clamping assembly and the, other end of the first beam having means such as for example a hook adapted to be rotatably connected to the umbrella structure. The assembly of the beam suspension portion, the umbrella structure and the clamping assembly creating thereby the improved mobile.

A further object of the invention is to provide the improved mobile where the first beam further comprises a lower portion and an upper portion a means for slideably interfitting and locking in interfitting relationship the lower and upper portions of the first beam. The lower and upper portions slideable and lockably interfitted create thereby a selected length of a plurality of selectable lengths for the first beam. The first beam lower portion has a length which is substantially linear but the upper portion may have an arcuate section which does not interfit with the lower portion. The arcuate section is integral with a linear section of the upper portion and which does interfit with the lower portion.

A still further object of the invention is to provide the beam suspension portion with both a first beam and a second beam attachable to said first beam. The first beam has one end adapted to cooperate with the means for rotatably, pivotaly and removably connecting to the clamping assembly. Another end of the first beam has means adapted to be rotatably and lockingly attachable to a first end of a second beam. The first end of the second beam and the another end of the first beam are adapted to interfit in rotatable and locking relationship. Further the second beam has a second end rotatably connected to the umbrella structure. The first and second beams when interconnected create thereby the beam suspension portion.

A yet still further object of the invention is to provide the improved portable mobile with a clamping assembly specially adapted to attach to 1he window glass of an automobile door. The beam portion attaches to the window clamping assembly in substantially the same manner as it attaches to the adjustable clamping assembly.

These and further objects of the present invention will become apparent to those skilled in the art to which this invention pertains and after a study of the present disclosure of the invention.

DESCRIPTION OF THE PREFERRED EMBODIMENTS

Figure 1:
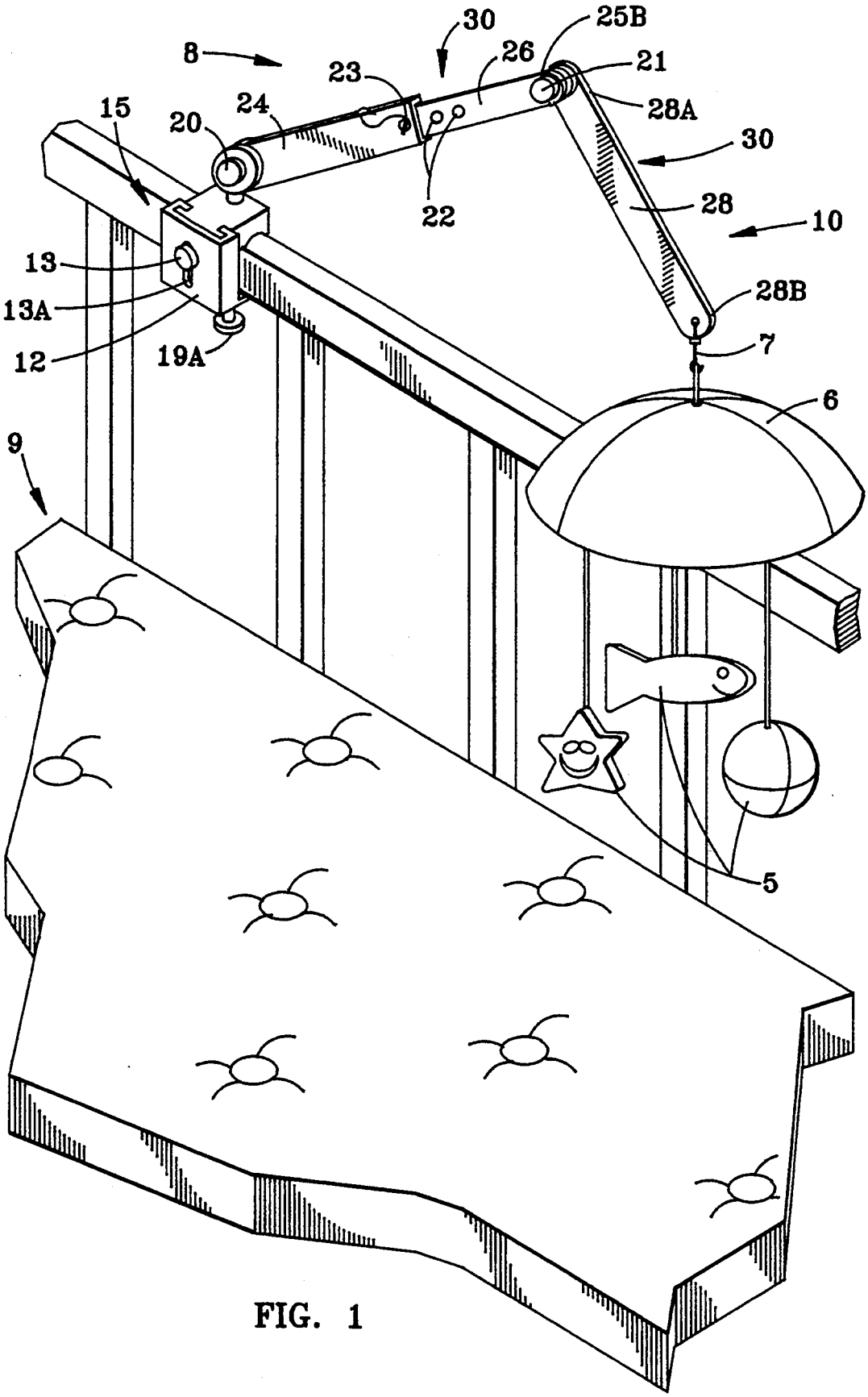
FIG. 1 is a perspective illustration of the improved portable mobile shown attached to a crib.

The following is a description of the preferred embodiment of the invention. It is clear that there may be variations in the size and the shape of the mobile, in the materials used in the construction and in the orientation of some of the components of the mobile. However, the main features of the improved portable mobile are consistent and are; versatility and usefulness in various environments, adjustability of the orientation of the elements hanging from the umbrella to enhance the play effectiveness of the mobile and the foldable characteristics of the mobile making transport more simple and thus more useful.

Reference is now made to FIGS. 1–7 all of which illustrate, by sketch, particular embodiments of improved portable mobile 10. The particular embodiment illustrated is the preferred one in which there is an improved toy support system 8 which provides for the adjustable support of umbrella structure 6 from which hang by any acceptable means, toys identified generically as numeral 5. Umbrella structure 6 hangs from hook 7 which hook 7 permits the rotation around a vertical axis of umbrella 6. Attaching hook 7 is attached to second end **28*b* of second beam 28 of beam suspension portion 30 (preferably comprising two beams, first beam 25 and second beam 28) of improved support system 8. Attached to one end of suspension portion 30 is clamping assembly 15. Clamping assembly 15 is attached to fixture 9**, in this instance a crib railing.

Means for connecting first beam 25 (or first end **28*a* of second beam 28 when only second beam 28 is the beam suspension portion—an embodiment not illustrated), one end thereof 25*a*, to clamping assembly 15 is identified by numeral 20. End 25*b* of first beam 25 is connected to first end 28*a* of second beam 28 by means 21. Connecting means 21 permits the relative rotation of first beam 25 to second beam 28. Illustrated in FIGS. 3, 4 and 6** is a toothed arrangement however, a friction surface could likewise be provided which would allow the same type of relative rotation.

Figure 2:
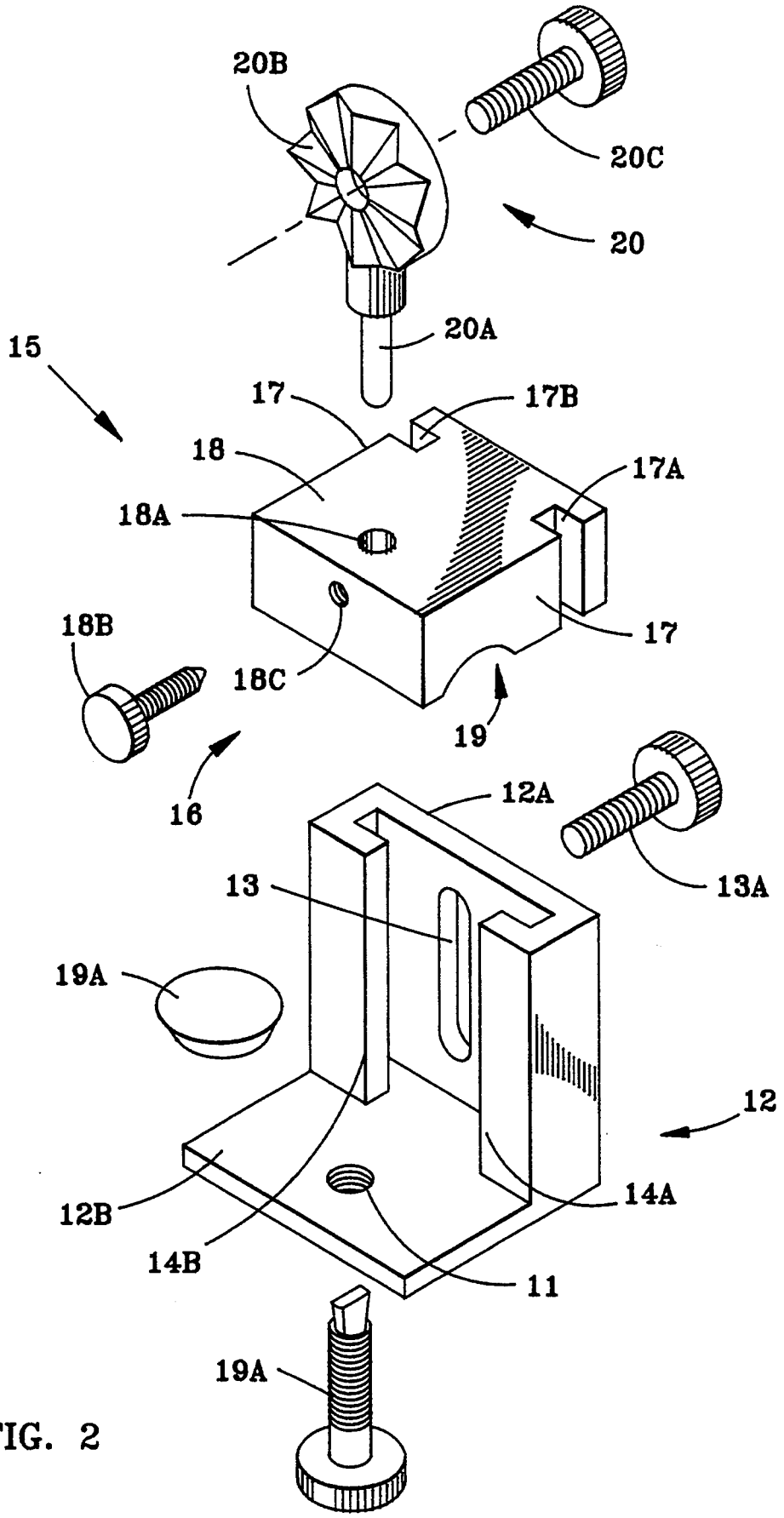
FIG. 2 is an exploded perspective sketch of the adjustable means for attaching the mobile to various forms of fixtures.

FIG. 2 more clearly illustrates details of a particular embodiment of means for removably attaching support system 8, when support system 8 is connected thereto—identified as numeral 15, to fixture 9. Means for attaching 15 is adjustable for attaching to varying fixture geometries. Means for attaching—referred to as clamping assembly 15—is made up of ell component 12 and block component 16. Set screw **18*b*, set screw hole 18*c* cooperate to clamp pin or shaft 20*a* and keep it in a fixed position when shaft 20*a* is inserted into hole 18*a* located on the upward facing surface 18. These features allow the rotational adjustment of beam suspension system 30 and thus permit the positioning of mobile toys 5 for play by the child. Connector between first beam 25 and clamping assembly 15 is numeral 20. Toothed surface 20*b* (which surface may be a friction surface End again need not be a toothed surface as indicated) interengages with end 25*a* of first beam 25 or with first end 28*a* of second beam 28 if only beam 28 is used. When end 25*a* is positioned in the preferred orientation clamping screw 20*c*** is tightened to keep the connection secure.

As can be seen in FIG. 2, block 16 has on two opposed sides 17, channels **17*a* and 17*b* both of which cooperate with tabs 14*a* and 14*b* thus permitting the sliding upward and downward of block 16 to accommodate varying fixture geometries. Clamp screw 13*a* will move within slot 13 and when tightened into a threaded hole in block 16 will maintain block 16 in position and create or define a clamp geometry to cooperate with the fixture geometry defined by clamping surface 19 and fixture clamping screw 19*a* which screw 19*a* and surface 19 are each adapted to contact fixture 19. Ell component 12 has two basic parts, side section 12*a* and base section 12*b*. In base section 12*b* is threaded hole 11 into which is threaded screw 19*a*. Also note that side section 12*a* has located thereon tabs 14*a* and 14*b* which insert into channels 17*a* and 17*b* of block 16**.

Figure 3:
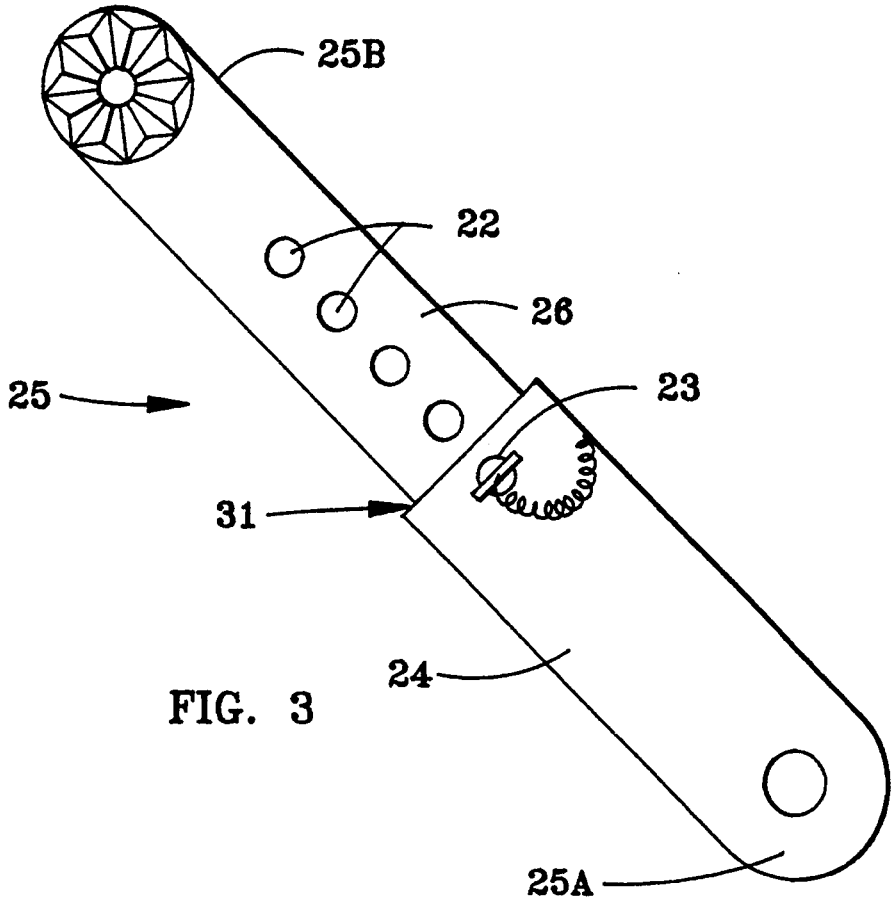
FIG. 3 is a side view of the lengthwise adjustable first beam illustrating lower and the upper portions and the cross sections of each of the portions and a particular means for locking the two portions at a length setting.
Figure 3A:
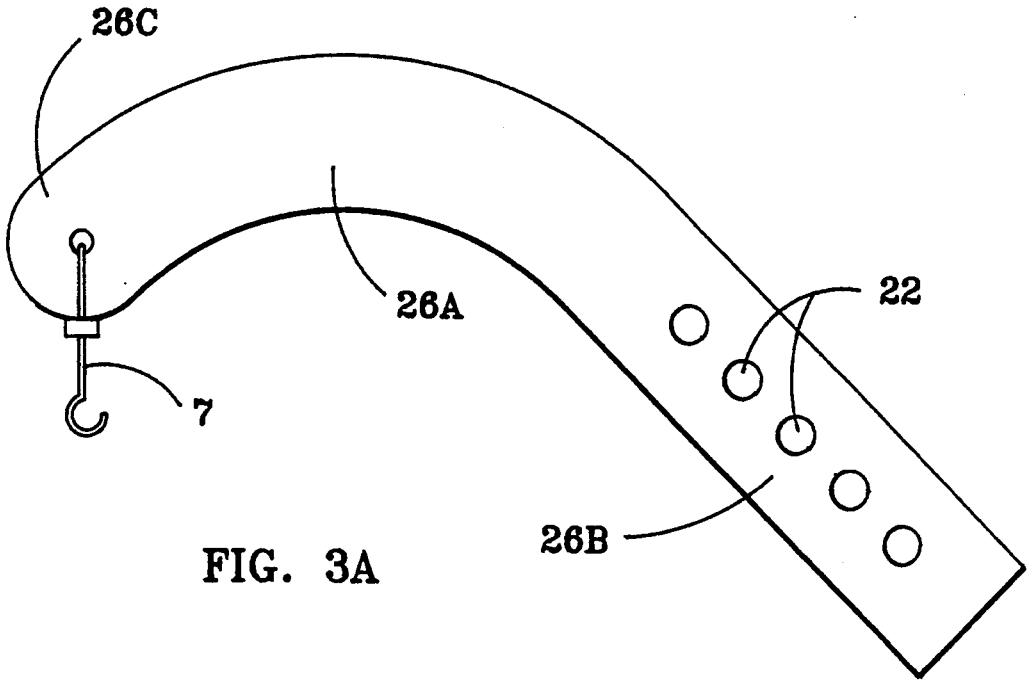
FIG. 3A is a side view of the lengthwise adjustable first beam illustrating the upper portions with a straight and an arcuate section.
Figure 4:
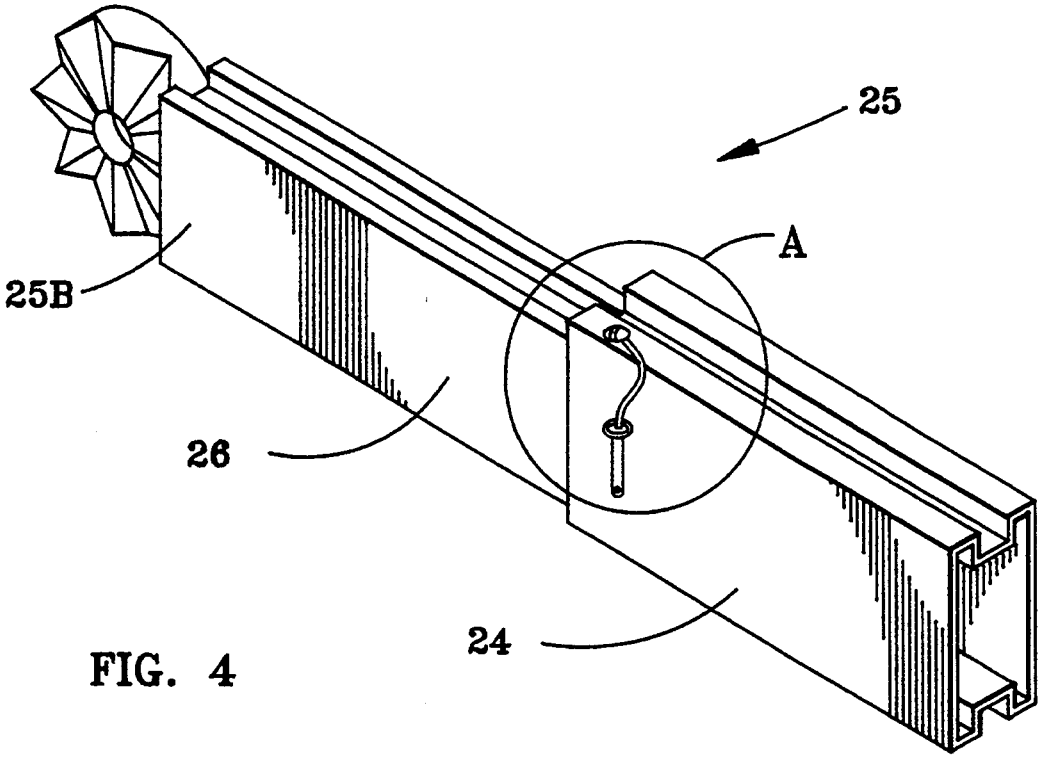
FIG. 4 is a detail view of another particular means for locking the length of the extension of the first beam.
Figure 4A:
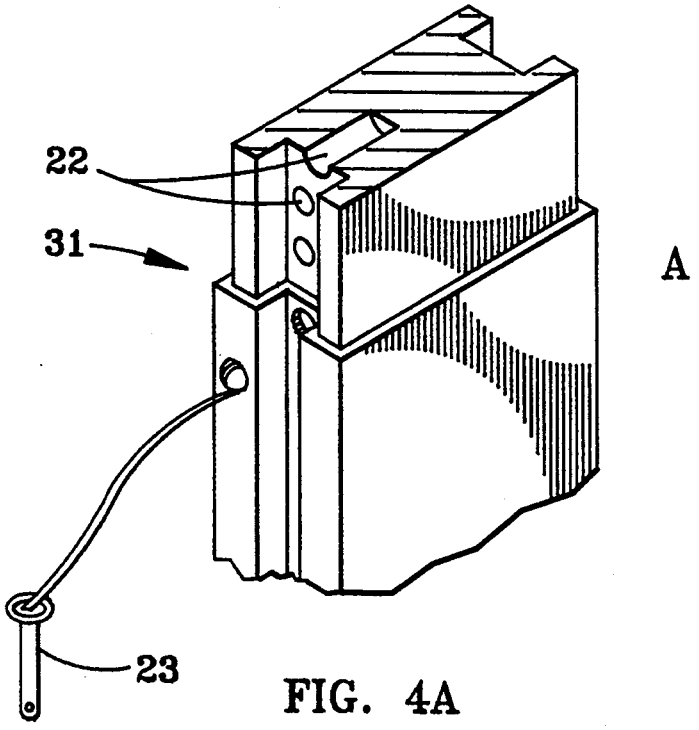
FIG. 4A is a detail view of the connection of the two portions of beam one interconnected by the particular means of FIG. 4.

FIGS. 3 and **3*a* illustrate some variations in first beam 25. Upper section 26 is preferably straight with holes or recesses 22 spaced along section 26. Means for slideably interfitting and locking in interfitting relationship, represented by numeral 31, the lower and upper portions 24 and 26 of the first beam 25, is shown as an "I" beam configuration (other structural configurations could be used providing that provision is made for lengthwise adjustment) including plurality of holes 22 and locking peg 23. Upper portion 26 is sized to slideably fit inside of lower portion 24. Then adjusting the length of beam 25 a selected one of holes 22 aligns with at least one aperture in lower section 24. Pin 23 is inserted through the aperture and through selected hole 22 thus creating a length for first beam 25. It is also within the scope of the invention to provide for only one beam for beam suspension portion 30. First beam 25 may have the configuration such that a section is arcuate 26*a* and a section is linear 26*b*. Linear section 26*b* is slideably assembled into lower portion 24 in the same manner as for upper portion 26. When first beam 25 incorporates upper section 26*a* and 26*b* it is intended that a second beam 28 is not used. In this instance arcuate section 26*b* has hook end 26*c* which attaches to umbrella structure 6**. This particular embodiment of improved portable mobile (not illustrated) would be used where there is a limitation on the amount of space in which to use the mobile.

Figure 5:
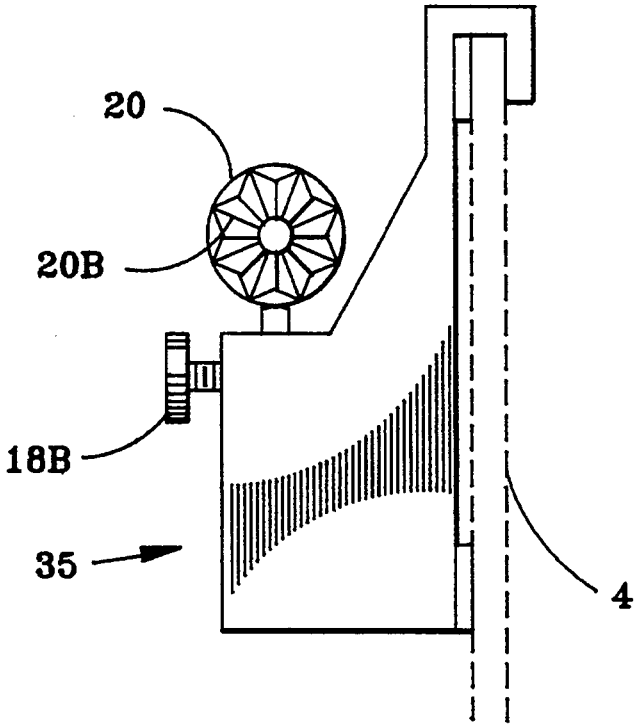
FIG. 5 is a side view sketch of the special means for attaching to a fixture adapted to be attachable to the door window glass of a typical automobile.
Figure 6:
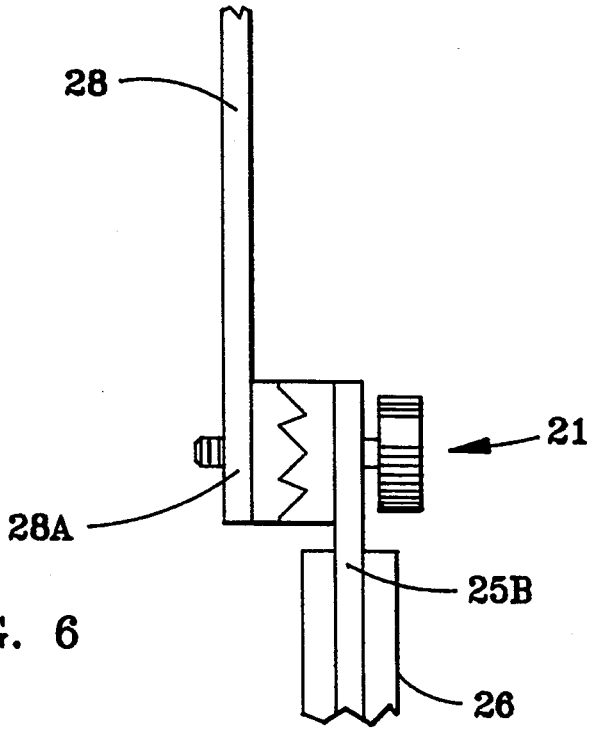
FIG. 6 is a top view schematic of a typical embodiment of the adjustable joint adapted to interfit in rotatable and locking relationship or connect the first beam to the second beam of the beam suspension portion.
Figure 7:
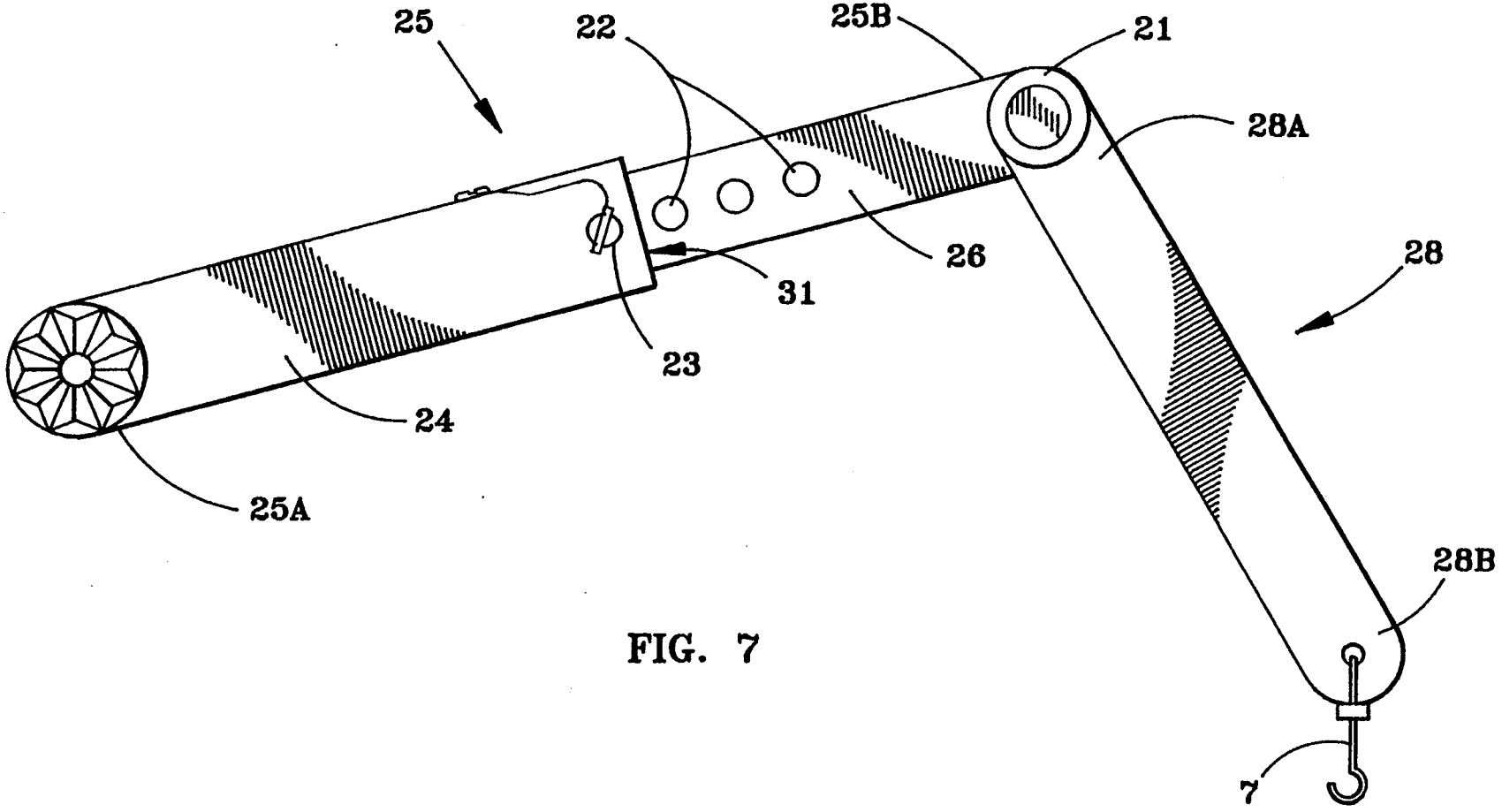
FIG. 7 is a side view schematic of both beams interconnected.

To provide for use of mobile 10 within an automobile, there is shown in FIG. 5 means for attaching 35 the mobile to the window glass 4 of an automobile. Clamping assembly 35 accepts connector 20 in a similar manner as does clamping assembly 15.

It is thought that the present invention, the improved portable mobile and many of its attendant advantages is understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. In an improved portable mobile toy having; at least one element attachable and suspendable from an umbrella structure, and an improved support system to which said umbrella structure is rotatably attachable, said improvement comprising:

means for removably attaching said support system, when said support system is connected thereto, to a fixture, said means for attaching adjustable for attaching to varying fixture geometries;

means for rotatably, pivotaly and removably connecting a beam suspension portion of said support system to said means for attaching to a fixture;

said beam suspension portion comprising; a second beam having means for adjusting a length thereof, having a first end adapted to cooperate with said means for rotatably, pivotaly and removably connecting to said means for attaching to a fixture, a second end of said second beam having means adapted to be rotatably connected to said umbrella structure and assembly of said beam suspension portion, said umbrella structure and said means for attaching to a fixture creating thereby said improved mobile wherein said means for removably attaching to a fixture comprises: an ell component with a base section and a side section integral therewith and substantially perpendicular thereto, said base section having located substantially central of said base section a threaded aperture therein, said side section having wall means defining a slot therethrough substantially perpendicular to said base section and said side section having two opposing and inwardly directed channel tab portions; a block component positionable within said base and side sections of said ell component having channels located on side faces of said block adapted to accept therein said channel tab portions thereby engaging said block and said ell component in a vertically slideably association, an upward facing surface having incorporated therein means for engaging said means for rotatably, pivotaly and removably connecting a beam suspension portion of said support system to said means for attaching to a fixture, and a clamping surface adapted to contact said fixture; a means for securing said block component and said angle component in a selected vertical positional relationship therebetween said positional relationship defining a clamp geometry to cooperate with said fixture geometry; and threaded screw means for clamping, by use of said clamping surface and said threaded screw means for clamping, said means for attaching to said fixture.

2. The improved portable mobile toy according to claim 1 wherein said means for engaging is a hole sized to accept thereinto said means for connecting said beam suspension portion to said means for attaching to a fixture.

3. In an improved portable mobile toy having at least one element attachable and suspendable from an umbrella structure and an improved support system to which said umbrella structure is rotatably attachable, said improvement comprising:

means for removably attaching said support system, when said support system is connected thereto, to a fixture, said means for attaching adjustable for attaching to varying fixture geometries;

means for rotatably, pivotaly and removably connecting a beam suspension portion of said support system to said means for attaching to a fixture;

said beam suspension portion comprising; a first beam having means for adjusting a length thereof, having one end adapted to cooperate with said means for rotatably, pivotaly and removably connecting to said means for attaching to a fixture, another end of said first beam having means adapted to be rotatably connected to said umbrella structure and assembly of said beam suspension portion, said umbrella structure and said means for attaching to a fixture creating thereby said improved mobile wherein said means for adjusting a length thereof of said first beam further comprises; a lower portion and an upper portion; means for slideably interfitting and locking in interfitting relationship said lower and upper portions of said first beam, with said lower and upper portions slideable and lockably interfitted creating thereby a selected length of a plurality of selectable lengths for said first beam and wherein said means for removably attaching to a fixture comprises: an ell component with a base section and a side section integral therewith and substantially perpendicular thereto, said base section having located substantially central of said base section a threaded aperture therein, said side section having a slot therethrough substantially perpendicular to said base section and said side section having two opposing and inwardly directed channel tab portions; a block component positionable within said base and side sections of said ell component having channels located on side faces of said block adapted to accept therein said channel tab portions thereby engaging said block and said ell component in a vertically slideably association, an upward facing surface having incorporated therein means for engaging said means for rotatably, pivotaly and removably connecting a beam suspension portion of said support system to said means for attaching to a fixture, and a clamping surface adapted to contact said fixture; a means for securing said block component and said angle component in a selected vertical positional relationship therebetween said positional relationship defining a clamp geometry to cooperate with said fixture geometry; and threaded screw means for clamping, by use of said clamping surface and said threaded screw means for clamping, said means for attaching to said fixture.

4. The improved portable mobile toy according to claim 3 wherein said means for engaging is a hole sized to accept thereinto said means for connecting said beam suspension portion to said means for attaching to a fixture.

5. In an improved portable mobile toy having; at least one element attachable and suspendable from an umbrella structure, and an improved support system to which said umbrella structure is rotatably attachable, said improvement comprising:

means for removably attaching said support system, when said support system is connected thereto, to a fixture, said means for attaching adjustable for attaching to varying fixture geometries;

means for rotatably, pivotaly and removably connecting a beam suspension portion of said support system to said means for attaching to a fixture;

said beam suspension portion comprising; a first beam having means for adjusting a length thereof and a second beam attachable to said first beam, said first beam having one end adapted to cooperate with said means for rotatably, pivotaly and removably connecting to said means for attaching to a fixture, another end of said first beam having means for to be rotatably and lockingly attachable to a first end of a second beam said first end of said second beam and said another end of said first beam adapted to interfit in rotatable and locking relationship; and said second beam having a second end rotatably connected to said umbrella structure said first and said second beams interconnected creating thereby said beam suspension portion and assembly of said beam suspension portion, said umbrella structure and said means for attaching to a fixture creating thereby said improved mobile wherein said means for adjusting a length thereof of said first beam further comprises a lower portion and an upper portion, means for slideably interfitting and locking in interfitting relationship said lower and upper portions of said first beam, with said lower and upper portions slideable and lockably interfitted creating thereby a selected length of a plurality of selectable lengths for said first beam and wherein said means for removably attaching to a fixture comprises: an ell component with a base section and a side section integral therewith and substantially perpendicular thereto, said base section having located substantially central of said base section a threaded aperture therein, said side section having a slot therethrough substantially perpendicular to said base section and said side section having two opposing and inwardly directed channel tab portions; a block component positionable within said base and side sections of said ell component having channels located on side faces of said block adapted to accept therein said channel tab portions thereby engaging said block and said ell component in a vertically slideably association, an upward facing surface having incorporated therein means for engaging said means for rotatably, pivotaly and removably connecting a beam suspension portion of said support system to said means for attaching to a fixture, and a clamping surface adapted to contact said fixture; a means for securing said block component and said angle component in a selected vertical positional relationship therebetween said positional relationship defining a clamp geometry to cooperate with said fixture geometry; and threaded screw means for clamping, by use of said clamping surface and said threaded screw means for clamping, said means for attaching to said fixture.

6. The improved portable mobile toy according to claim 5 wherein said means for engaging is a hole sized to accept thereinto said means for connecting said beam suspension portion to said means for attaching to a fixture.

* * * * *